US007341068B2

(12) United States Patent
Liu

(10) Patent No.: US 7,341,068 B2
(45) Date of Patent: Mar. 11, 2008

(54) SIDE-SUPPORTING UMBRELLA

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 281 days.

(21) Appl. No.: 10/942,926

(22) Filed: Sep. 17, 2004

(65) Prior Publication Data

US 2006/0081277 A1 Apr. 20, 2006

(51) Int. Cl.
*A45B 11/00* (2006.01)

(52) U.S. Cl. ..... 135/20.3; 135/20.1; 135/21; 248/229.1

(58) Field of Classification Search ..... 135/20.1, 135/98, 21, 20.3; 248/291.1, 229, 292.13, 248/231.61, 230.5, 229.1; 403/322, 373, 403/110

See application file for complete search history.

(56) References Cited

U.S. PATENT DOCUMENTS

| | | | | | |
|---|---|---|---|---|---|
| 3,383,814 | A * | 5/1968 | Rowe | 52/83 |
| 4,174,822 | A * | 11/1979 | Larsson | 248/75 |
| 4,312,465 | A * | 1/1982 | Sinkhorn et al. | 224/414 |
| 5,386,961 | A * | 2/1995 | Lu | 248/223.41 |
| 5,405,113 | A * | 4/1995 | Jaw | 248/229.1 |
| 5,669,536 | A * | 9/1997 | Wang | 224/443 |
| 5,704,526 | A * | 1/1998 | Kuo | 224/425 |
| 5,785,069 | A * | 7/1998 | Glatz | 135/20.1 |
| 5,937,882 | A | 8/1999 | Harbaugh | |
| 6,196,242 | B1 * | 3/2001 | Xu | 135/20.1 |
| 6,401,735 | B1 * | 6/2002 | Chou | 135/20.1 |
| 6,412,506 | B1 * | 7/2002 | Reese | 135/20.1 |
| 6,588,438 | B1 * | 7/2003 | Steiner | 135/20.1 |
| 6,619,306 | B2 * | 9/2003 | Ma | 135/21 |
| 6,923,193 | B2 * | 8/2005 | Chen | 135/20.1 |
| 6,971,564 | B2 * | 12/2005 | Yang | 224/425 |

FOREIGN PATENT DOCUMENTS

| | | | |
|---|---|---|---|
| FR | 2737244 | * | 4/1996 |
| GB | 2409234 | * | 6/2006 |
| JP | 2003-27683 | * | 1/2003 |
| TW | 485769 | | 7/2001 |

* cited by examiner

*Primary Examiner*—Winnie Yip
(74) *Attorney, Agent, or Firm*—Birch, Stewart, Kolasch & Birch, LLP

(57) ABSTRACT

The present invention relates to a side-supporting umbrella. A collar is installed on a mast, and able to slide along the mast in a continuously variable manner, and pivotally connected to a supporting arm of a canopy. A movement of the collar sequentially actuates another movement of the pivotally interlinked supporting arm to adjust the tilt of the canopy, and the collar can be fixed at any position of the mast by a locking element. Thus, the canopy can be adjusted to any tilt attitude in response to the solar radiation coming from any direction. Besides, a controlling line of the present is inside-installed in order to prevent the line from exposure to the environment and avoid wear or damage of the line and then prolong the life of the umbrella and promote the operating safety.

5 Claims, 5 Drawing Sheets

SIDE-SUPPORTING UMBRELLA

FIELD OF THE INVENTION

The present invention relates to a side-supporting umbrella and particularly to a side-supporting umbrella canopy of which can be adjusted to tilt to any angles with respect to the mast, and controlling line of which is inside-installed.

BACKGROUND OF THE INVENTION

The outdoor leisure activities are the best and most popular way to relax tension from busy weekday work. People can always enjoy their leisure time from outdoor activities, such as picnic, camping, barbecue, etc. However long time and over solarization during outdoor activities makes ones intolerable, not only the skin will become swarthy, but also ones may get sunstruck from ultraviolet, or even suffer a heat exhaustion. Therefore, ones often employ a sunshade or umbrella to avoid exposure to direct sunlight. However, the radiating angle of the sun shifts during times, and the conventional umbrella cannot meet the need.

Referring to a prior art "Improved Angle-Adjusting Structure of Crank-Hanging Umbrella" of Taiwan Patent published No. 485769, the angle-adjusting structure of this prior art comprises a cylindrical housing and a tilt-fixing mechanism disposed inside the housing. The canopy-supporting arm is engaged fixedly with the angle-adjusting portion. The direction-shifting part, which is in the lower part of the angle-adjusting portion, undertakes direction-shifting function inside the housing, and the canopy-supporting arm changes its angle responsively, and thus the shielding range of the canopy is adjusted. The displacement element of the tilt-fixing mechanism is screwed upward to press tightly the limiting element and fix the angle-adjusting portion, and thus the angle of the canopy is fixed. This prior art utilizes the direction-shifting part inside the housing to undertake angle adjustment. However the sphere diameter of the direction-shifting part is larger than that of the opening of the housing, thus there is always abrasion between the direction-shifting part and the opening of the housing, and the opening of the housing tends to be worn and deformed. Consequently, the direction-shifting part cannot be fixed firmly, and the angle adjustment of the crank-hanging umbrella cannot be performed.

Referring to another prior art published U.S. Pat. No. 5,937,882, the tilt-adjusting mechanism disclosed therein includes: a collar, slidably mounted along the mast, and pivotally connected to a supporting arm of the canopy, with the canopy tilting angle being adjusted through the sliding movement of the collar along the mast and the sequentially actuated movement of the supporting arm; and a plurality of positioning holes on the mast, with a selected one inserted through by a lock element to lock the position of the collar on the mast and determine the canopy tilt angle. As those positioning holes are disposed at a given interval, the canopy tilt angles are limited to those discrete positions of the positioning holes, and therefore the umbrella cannot shield all the solar radiation, which may come from any direction. One end of a connecting brace pivotally attaches at the top of the mast, and the other end pivotally connects to the supporting arm of the canopy. The mast has a winder, which utilizes a line passing through the umbrella to enable the canopy to open or close via a series of sequentially actuated movements of the interlinked elements. One end of the line is wound on the winder, and the other end passes through tubes of the mast and arm to connect with a knob immediately below the lower hub of the canopy. By turning the winder, the line is wound or released to enable the canopy to open or close. The path of the line begins from the winder, and then extends through the tube of the mast to a first pulley, and then extends downward outside the mast to pass over a second pulley carried by the collar, and then extends along a the tube of the arm to pass over a third pulley at the top of the canopy, and downward through a upper hub of the canopy to the lower hub, and then terminates below the lower hub. The line path between the first pulley and the second pulley is exposed to the environment, and to be easily worn, damaged, and finally broken, and then the umbrella cannot operate any more. Accordingly, life of the umbrella is shortened.

SUMMARY OF THE INVENTION

The primary objective of the side-supporting umbrella of the present invention is to provide a tilt-adjusting structure installed between a mast of an umbrella and a supporting arm of a canopy, comprising a collar, which can slide along the mast in a continuously variable manner and adjust the tilt of the canopy in combination with a sequentially actuated movement of the interlinked supporting arm, and is able to be fixed at any position of the mast by a locking element. Accordingly, the canopy can be adjusted to any tilt attitude, and shield the solar radiation coming from any direction. Thus, the problems of the prior art can be improved that the collar can only be fixed at the predetermined discrete positions via inserting the locking element therethrough into one of positioning holes disposed at a set of given positions along the mast, and then the adjustment of the canopy can only be limited to a set of predetermined tilts.

Another objective of the present is to prevent a line from wear or damage resulting from exposure thereof to the environment and resulting in incapability of the umbrella operation. Therefore, the present invention designs anew an extending path of the line, which enables the canopy to open or close via a series of sequentially actuated movements of the interlinked elements, to prevent the line from exposure to the environment and avoid the wear or damage of the line in order to prolong the life of the umbrella and promote the operating safety.

According to one aspect of the present invention, the mast and the supporting arm of the canopy are interconnected with a connecting brace pivotally, and the collar is connected to the supporting arm pivotally also. The mast has a crank-driving winder, on which a line is wound, and via crank-driving the winder, the line is driven to control the canopy to open or close. An upper hub is installed at the top of the canopy, and a lower hub is installed below the upper hub coaxially. Disposing spaces are form inside the mast, the connecting brace and the supporting arm separately. The line begins from the winder, and extends through the disposing spaces to the upper hub, and then connects to the lower hub in order to achieve the aforementioned objective.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
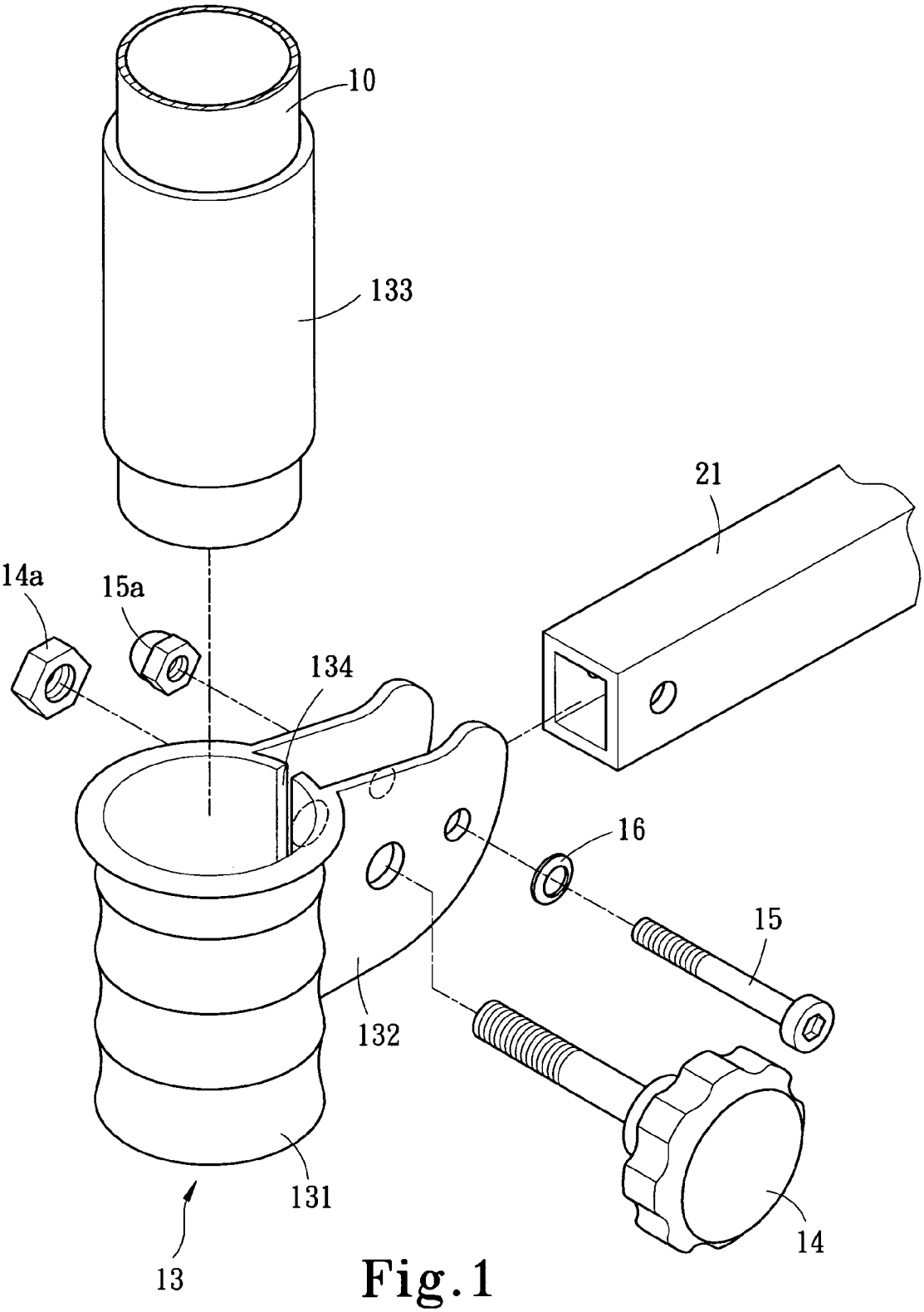
FIG. 1 is an exploded schematic diagram according to one embodiment of the present invention.
Figure 2A:
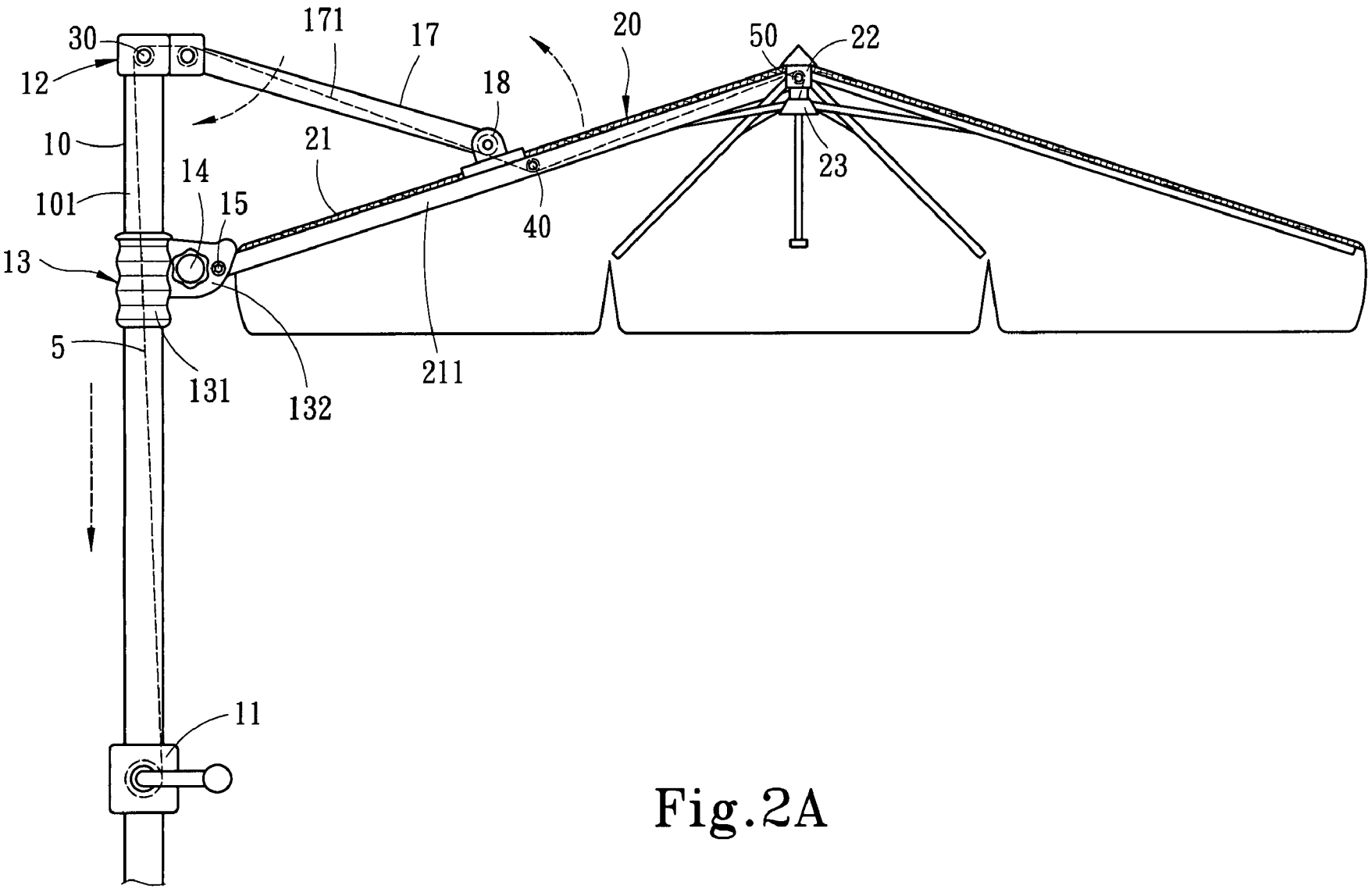
FIGS. 2A and 2B is a schematic diagram of tilt-adjusting motion according to one embodiment of the present invention.

Referring to FIG. 1 an exploded schematic diagram and FIG. 2A a schematic diagram of tilt-adjusting motion, both according to one embodiment of the present invention, a tilt-adjusting structure of the present invention is installed on a mast 10, and pivotally connected to a supporting arm 21 of a canopy 20. The mast 10 and the canopy 20 are interconnected with a connecting brace 17 pivotally. The connecting brace 17 is pivotally connected through a pivoting element 18 to the supporting arm 21. A crank-driving winder 11 is installed at a suitable position of the mast 10, and one end of a line 5 is wound on the winder 11 in order to control the canopy 20 to open or close. An upper hub 22 is installed at the top of the canopy 20, and a lower hub 23 is installed below the upper hub 22 coaxially. A first disposing space 101 is formed inside the mast 10, and a first pulley 30 is installed at the top of the mast 10. A second disposing space 171 is formed inside the connecting brace 17. A third disposing space 211 is formed inside the supporting arm 21, and a second pulley 40 is installed inside the supporting arm 21. A third pulley 50 is installed in the upper hub 22. One end of the line 5 begins from the winder 11, and extends through the first disposing space 101 of the mast 10 upward to the top thereof, and passes over the first pulley 30, and then via the first direction transition, extends through the second disposing space 171 of the connecting brace 17 to the second pulley 40 installed in side the supporting arm 21, and passes over the second pulley 40, and then with the second direction transition, extends through the third disposing space 211 of the supporting arm 21 to the third pulley 50 installed in the upper hub 22, and passes over the third pulley 50, and then via the third direction transition, extends through the upper hub 22, and finally reaches the lower hub 23 and connects thereto. Via crank-driving the winder 11, the line 5 is driven to control the canopy 20 to open or close.

A tilt-adjusting structure according to one embodiment of the present includes: a collar 13, having a holding portion 131 mounted cylindrically through the mast 10, and able to slide between the winder 11 and the top of the mast 10 in a continuously variable manner. An assembling portion 132 projects from the holding portion 131. The assembling portion 132 is pivotally connected to the supporting arm 21 via inserting a locking element 15 through a washer 16, the assembling portion 132 and the supporting arm 21, and screwing those fixedly with a nut 15*a*. The holding portion 131 has a slot 134. The holding portion 131 is gripped fixedly and positioned on the mast 10 via inserting a positioning element 14 through the assembling portion 132 and screwing a nut 14*a* to press the slot 134 tightly. Besides, a lining sleeve 133 can be installed inside the holding portion 131 to reduce friction resulting from a sliding motion between the collar 13 and the mast 10 and prevent the mast 10 from wear and deformation As the radiating direction of the sun is always shifting, users have to adjust the tilt attitude of the canopy responsively to match the radiating condition and avoid direct exposure to the sunlight.

Figure 2B:
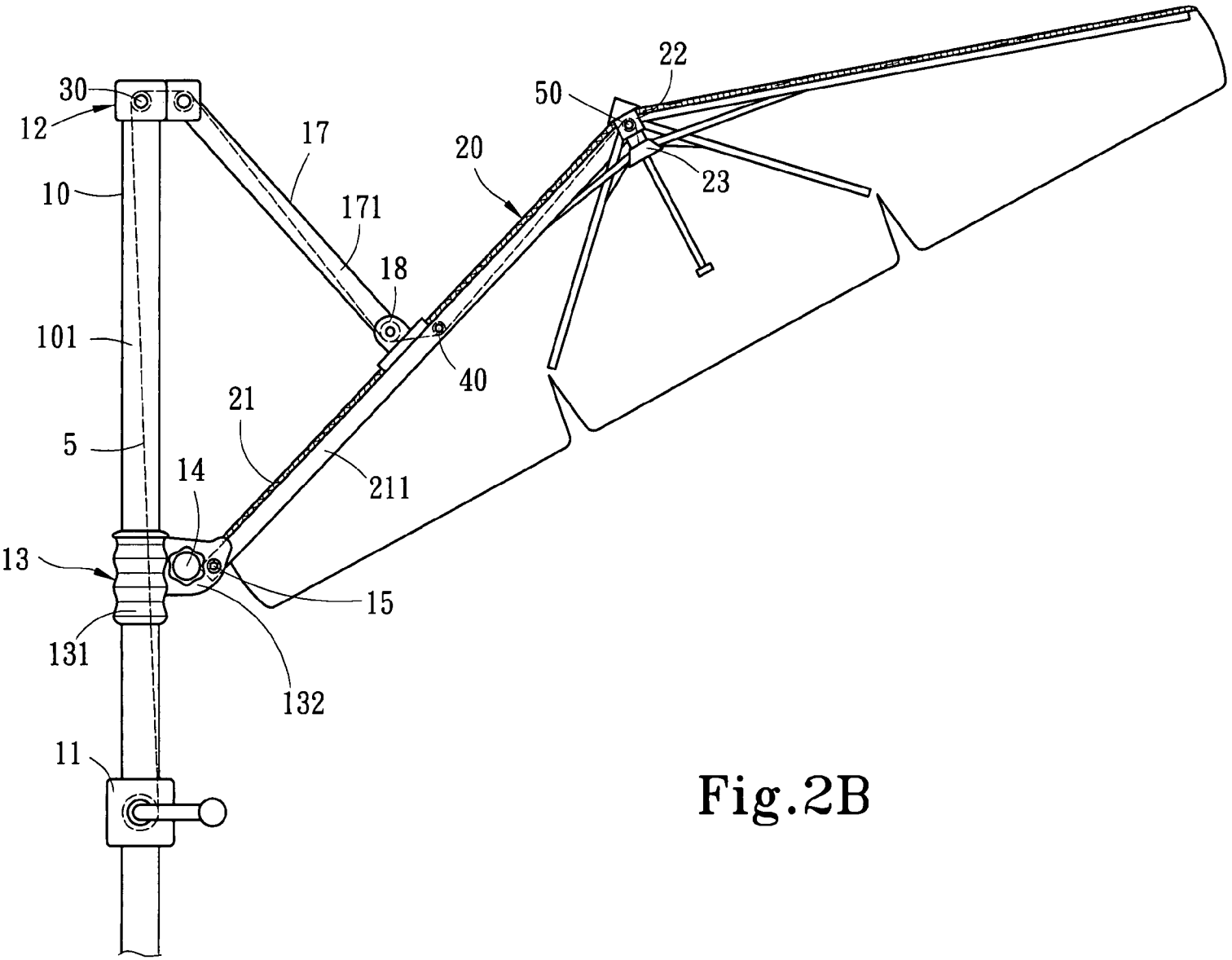

Referring to FIGS. 2A and 2B, a schematic diagram of tilt-adjusting motion according to one embodiment of the present invention, at first, the positioning element 14 at the assembling portion 132 is screwed out to disengage the nut 14*a* from the positioning element 14 to relax the slot 134 from tightly-pressed state, and then release the holding portion 131 from tightly-gripped and fixedly-positioned state. Then, the collar 13 is pulled to slide downward, and the holding portion 131 is moved from the position adjacent to the top of the mast 10 to the position adjacent to the winder 11. As the assembling portion 132 is pivotally connected to the supporting arm 21, moving the holding portion 131 along the direction indicated by the arrow in the FIG. 2A will actuate the supporting arm 21 to pivotally rotate toward the connecting brace 17 with the pivoting element 18 being the pivot axis. While the collar 13 continues to slide downward, the connecting brace 17 will be actuated to pivotally rotate toward the mast 10 with a connecting element 12 being the pivot axis. Thus, the tilt attitude of the canopy 20 is adjusted to shield the solar radiation.

Vice versa, while the collar 13 slide upward, the holding portion 131 of the collar 13 is moved from the position adjacent to the winder 11 to the position adjacent to the top of the mast 10, and thus the tilt attitude of the canopy 20 is also changed. As the actions of the reverse operation are similar to those described above, its description will not repeat.

Figure 3:
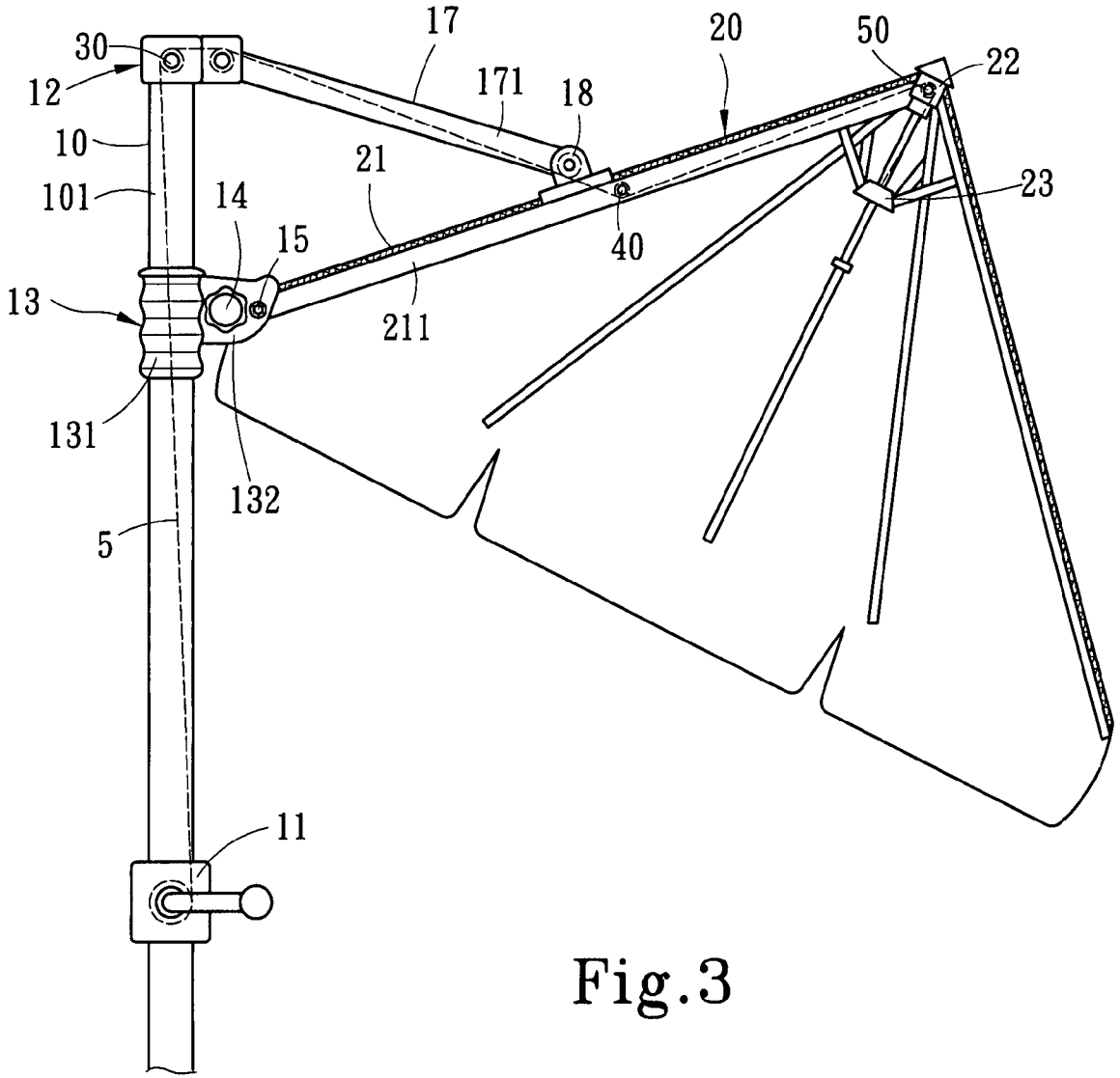
FIG. 3 is a schematic diagram showing a half-open state of the canopy of the umbrella according to one embodiment of the present invention.
Figure 4:
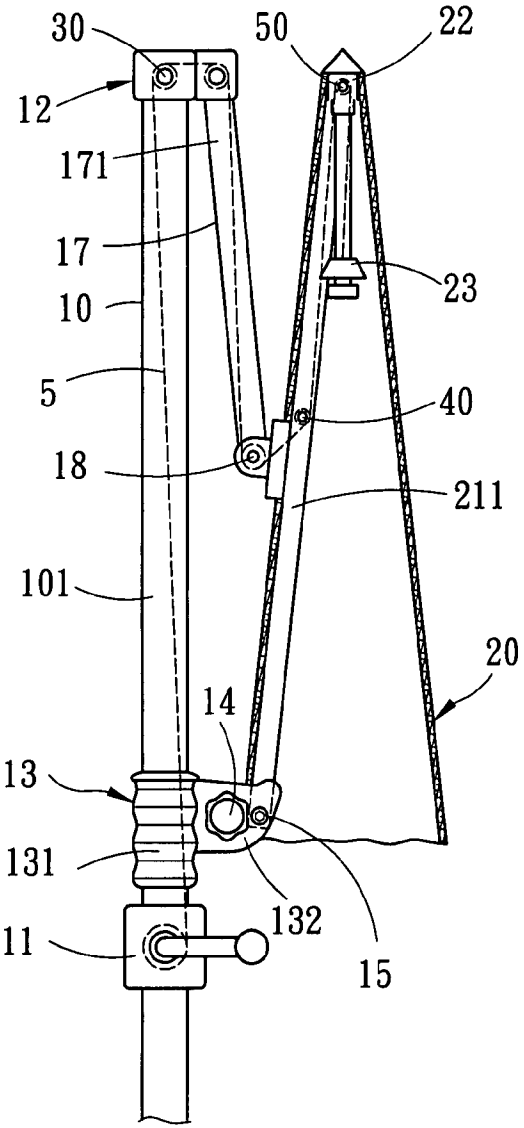
FIG. 4 is a schematic diagram showing a fully-close state of the canopy of the umbrella according to one embodiment of the present invention.

Referring to FIGS. 2A, 3 and 4, schematic diagrams showing half-open or fully-close states of the canopy of the umbrella according to one embodiment of the present invention, via crank-driving the winder 11, the length of the line will increase to make the lower hub 23 move downward in order to open the canopy 20, or the length of the line will decrease to make the lower hub 23 move upward in order to close the canopy 20. As described above, after disengaging the nut 14a from the positioning element 14, the collar 13 is pulled to slide downward, and the holding portion 131 of the collar 13 is moved from the position adjacent to the top of the mast 10 to the position adjacent to the winder 11, and then the tilt attitude of the canopy 20 will be changed to adjoin the mast 10, and the volume of the umbrella will decrease to make its stowing or transport convenient.

Those described above is only the preferred embodiments of the present invention, and it is not intended to limit the scope of the present. Any equivalent variation or modification according to the spirit or the appended claims of the present invention is to be included within the scope of the present invention.

What is claimed is:

1. A side-supporting umbrella, comprising a canopy and a mast which supports the canopy, wherein said canopy has a supporting arm, with said supporting arm and said mast, through a connecting brace, pivotally interconnecting to each other, and further comprising a collar and a positioning element, the collar being installed on said mast, said collar being slidable along said mast, and said collar being pivotally connected to said supporting arm of said canopy, the positioning element being equipped for said collar, and a tilt angle being adjusted via said collar sliding along said mast and fixing said collar on said mast with said positioning element, said collar having a holding portion which is cylindrically installed on said mast, and an assembling portion projecting from said holding portion which is pivotally connected to said supporting arm, the holding portion has a slot and the holding portion being gripped fixedly and positioned on said mast via inserting said positioning element through said assembling portion and fastening said assembling portion to press tightly said slot, a lining sleeve being installed inside said holding portion to reduce friction between said holding portion and said mast.

2. The side-supporting umbrella according to claim 1, wherein a crank-driving winder is installed on said mast, and a line is wound on said winder, and wherein an upper hub is installed at the top of said canopy, and a lower hub is installed below said upper hub coaxially, and wherein said mast has a first disposing space, and said connecting brace has a second disposing space, and said supporting arm has a third disposing space, and wherein said line begins from said winder, and extends through said first disposing space of said mast, said second disposing space of said connecting brace, said third disposing space of said supporting arm, said upper hub, and said lower hub, and said line is connected to said lower hub, and wherein via crank-driving said winder, said line is driven to control said canopy to open or close.

3. The side-supporting umbrella according to claim 2, wherein a first pulley is installed at the top of said first disposing space of said mast, and said line has a first direction transition at said first pulley.

4. The side-supporting umbrella according to claim 2, wherein a second pulley is installed inside said third disposing space of said supporting arm, and said line has a second direction transition at said second pulley.

5. The side-supporting umbrella according to claim 2, wherein a third pulley is installed inside said upper hub, and said line has a third direction transition at said third pulley.

* * * * *